US007111344B2

(12) United States Patent
French

(10) Patent No.: US 7,111,344 B2
(45) Date of Patent: Sep. 26, 2006

(54) INFANT SLEEPING SYSTEM

(76) Inventor: Darcie Marie French, 33352 Wren Cr., Abbotsford, British Columbia (CA) V2S 5W1

( * ) Notice: Subject to any disclaimer, the term of this patent is extended or adjusted under 35 U.S.C. 154(b) by 0 days.

(21) Appl. No.: 10/907,165

(22) Filed: Mar. 23, 2005

(65) Prior Publication Data

US 2005/0210585 A1 Sep. 29, 2005

Related U.S. Application Data

(60) Provisional application No. 60/556,405, filed on Mar. 26, 2004.

(51) Int. Cl.
*A47G 9/02* (2006.01)

(52) U.S. Cl. ..... 5/494; 5/413 R; 2/69.5; 128/872

(58) Field of Classification Search ..... 5/494, 5/413 R, 498; 128/872; 2/69.5
See application file for complete search history.

(56) References Cited

U.S. PATENT DOCUMENTS 1,964,271 A * 6/1934 O'Dwyer ..... 128/873
2,419,989 A * 5/1947 Day ..... 2/114
3,536,067 A * 10/1970 Sternagel ..... 128/873
3,845,513 A 11/1974 Hubner
3,987,505 A 10/1976 Hickery
4,202,052 A * 5/1980 Bilanzich ..... 2/69.5
4,858,625 A * 8/1989 Cramer ..... 128/872
5,746,219 A 5/1998 McConnell
6,009,576 A 1/2000 Gramme et al.
6,301,729 B1 10/2001 Hall
6,393,612 B1 5/2002 Thach et al.
6,631,528 B1 10/2003 Landry
6,640,340 B1 11/2003 Gibson
6,662,390 B1 12/2003 Berger
6,684,437 B1 2/2004 Koenig
6,708,356 B1 3/2004 LaValle
6,817,048 B1 11/2004 LaRosa
6,848,131 B1 * 2/2005 Landry ..... 5/494
6,868,566 B1 * 3/2005 Gatten ..... 5/494
2004/0019969 A1 2/2004 Gatten
2004/0139527 A1 7/2004 Damir et al.

* cited by examiner

*Primary Examiner*—Michael Trettel
(74) *Attorney, Agent, or Firm*—Vermette & Co.

(57) ABSTRACT

A crib sheet with attachment points used to attach to the crib rails or bed frame. The crib sheet is used in combination with an infant sleep garment that attaches to the crib sheet by hook and loop mechanism. Attachment to the crib frame or bed frame, rather than the mattress, eliminates the risk that the infant's movements can cause the crib sheet to move or shift. Two points of attachment lie on either side of the shoulders or upper torso of the infant. The sleep garment has a arm restraint mechanism that acts to prevent movement of the infant's arms so that the infant cannot use its arms to escape the garment or to move itself about the crib or bed.

17 Claims, 3 Drawing Sheets

INFANT SLEEPING SYSTEM

RELATED APPLICATIONS

The present application claims the benefit of U.S. Provisional Patent Application 60/556,405, filed on Mar. 26, 2004.

FIELD OF THE INVENTION

The present invention relates to infant sleepwear which allows an infant to sleep on its back, but prevents it from rolling over onto its stomach or moving about the crib and becoming entangled or lodged between the crib railings.

BACKGROUND OF THE INVENTION

Newborn babies are accustomed to the close, warm, secure environment of their mother's womb prior to birth. Newborns and young infants are commonly wrapped in swaddling type blankets to provide warmth and comfort, which simulates the cocoon-like state of the mother's womb. Swaddling mimics the pre-birth experience resulting in a comfortable and content newborn. Swaddling also helps settle the developing nervous system of the infant since newborns are overwhelmed by novel feelings and sensations in their nerves; swaddling places an infant's muscles and joint position sensors at rest.

Swaddling has been shown to calm babies with colic and fussiness. Swaddling especially settles the startle reflex in preventing the flailing of the infant's arms and thus helps the infant feel more secure.

In addition to providing comfort and warmth, parents and caregivers must provide protection from danger in an infant's sleep environment. This is generally achieved through safe positioning of infants so that they are prevented from getting into awkward positions and either harming themselves or waking themselves unnecessarily.

A general problem for positioning infants for sleep is the risk that a blanket or bedding will be loosened and/or re-positioned during sleep. In the case of the blanket being moved off the infant's body, there is a risk that the infant will become chilled from exposure to cold air and in the case of the blanket being moved over the infant's face, there is the risk of the infant suffocating from lack of oxygen.

Swaddling, if done properly, reduces the risk that an infant will become uncovered or that the swaddling blanket or bedding will come loose. However, swaddling alone cannot eliminate these risks. This is especially true for infants that are more than six weeks old, when they are stronger and more active than newborns. Furthermore, many parents and caregivers have difficulty properly swaddling infants. To obtain a proper swaddle and to achieve the desired result, the blanket must be snug enough to immobilize the infant's arms and, to a certain degree, its legs, but loose enough that it is still comfortable.

Many parents experience difficulty with swaddling due to unfamiliarity with swaddling folds; it is difficult to effectively swaddle an infant in a rectangular or square-type blanket. If not swaddled correctly, the infant often wriggles free of the swaddle, resulting in the arms being freed and vitiating the desired effect. An infant wriggling free of the swaddling blanket also is exposed to a serious risk of suffocation or SIDS related issues due to loose bedding and unrestricted positioning of the infant. Even when swaddled correctly, infants can potentially roll, becoming entrapped in the swaddling blanket or trapped faced down while still wrapped in the blanket.

The difficulties with current swaddling blankets, sleep garments, and sleep safety devices include: a propensity to come undone and become loose in the crib, putting the infant at risk of suffocation; difficulty of proper and effective application; and an inability to prevent the infant from rolling into a prone position, thus potentially becoming trapped face down in the blanket creating a serious safety issue.

Other available swaddling implements on their own may be sufficient to swaddle and position an infant during the six week post-partum stage when the infant lacks the strength and developmental capacity to roll or break free. However, after the newborn stage and still within the period of time an infant is at risk for SIDS and/or other sleep-related hazards, many implements do not properly restrain the infant's arms, do not stay on the infant's body, and do not prevent the infant from rolling into a face-down position.

In light of recent research on SIDS, it is recommended babies be placed on their backs for sleeping for as long as the infant will tolerate this position during the infant's first year. Unfortunately, presently available infant positioning implements have difficulties related to functionality and safety. Examples include, but are not limited to, positioning wedges, foam apparatus and rolled pieces of fabric.

U.S. Pat. No. 3,845,513 discloses a fitted sleeping sac that is attached to a sheet. The arms of the infant are not restrained, thereby allowing the infant to move freely and to escape the sleeping sac. Furthermore, the sheet is simply a fitted sheet with a band that passes around the mattress, which is likely to be shifted by the movements of the infant, thereby exposing it to risk of injury.

U.S. Pat. No. 6,009,576 discloses a body conforming blanket that forms a pouch by using flaps that are wrapped and secured by using a hook and loop fastening system. With this design, the infant is not prevented from rolling over or from wriggling free or kicking its way out of the blanket.

U.S. Pat. No. 6,301,729 discloses a pocket type bedding device that secures an infant between a sheet and the mattress cover. It does not restrain the infant's movements, the infant is not prevented from rolling over, and the infant can escape as easily as from regular bed sheet or blanket.

U.S. Pat. No. 6,631,528 discloses a crib sheet with a blanket sewn on it to wrap around the infant to retain the infant in a supine position. This device does not swaddle the infant, rather, it simply wraps around the baby's torso leaving the arms and shoulders free. Because the infant's arms remain free, this design allows a baby a great deal of mobility. In practice, an infant is still able roll onto its stomach within the apparatus, exposing the infant to a risk for SIDS and suffocation. In addition, since the crib sheet is fastened about the mattress, it is likely to be shifted by the movement of the infant, thereby potentially loosening bedding and bringing the infant closer to the edge of the bed/crib.

U.S. Pat. No. 6,817,048 discloses an infant restraining device with a bottom sheet tied to a mattress with ropes or ties and a sleep pouch attached to the bottom sheet by a material pivot and with a piece of hook and loop material. It is suggested in the '048 patent that the material pivot allows the infant to move, without allowing it to rollover. However, in practice, it is unnecessary and simply increases the risk that the baby will rollover and/or become entangled. Furthermore, the device of the '048 patent leaves the infants arms free, which significantly increases the risk that the infant will be able to escape. In particular, the device has Velcro™ shoulder straps that are fastened on the front of the infant within easy reach of the infant's hands. The infant can, therefore, easily undo the straps with its hands, effectively defeating the purpose of the device. In addition, having long, thin straps so close to a child's neck presents an unnecessary hazard. These straps pose a risk of chafing and/or strangulation if they were to come undone.

The apparatus of the '048 patent uses a bottom sheet that is a "half-sheet mattress cover" attached to a mattress with straps going underneath to the other side. The infant's movement can cause the entire blanket, device and infant to shift over to the edge of the bed, thereby defeating the purpose of the device.

Thus, there remains a need in the art for an infant bedding product which functions to restrain an infant's movements, keeps an infant warm, prevents the infant from escaping, prevents an infant from moving from a supine or side-lying position to a dangerous prone position, and prevents an infant from shifting or loosening the bedding.

SUMMARY OF THE INVENTION

The present invention addresses the defects inherent in known swaddling and positioning devices by providing a novel sleeping garment and crib sheet which, when used together, position the infant safely in a supine position in the sleep environment.

The present invention consists of a crib sheet with a minimum of two attachment points, (preferably six) used to attach to the crib rails or bed frame. The crib sheet attachment points may take the form of secure locking clips, heavy-duty snaps, or other suitable fasteners. Attachment to the crib frame or bed frame, rather than the mattress, eliminates the risk that the infant's movements can cause the crib sheet to move or shift. Two attachment points lie on opposite edges of the crib sheet and on either side of a connector, for attachment of a sleep garment to the crib sheet.

The crib sheet is used in combination with an infant sleep garment that attaches to the connector of the crib sheet by hook and loop mechanism (e.g. Velcro™). The sleep garment restrains movement of the infant's arms, preventing the infant from using its arms to move itself about the crib or bed, and its hands to escape the sleep garment. The sleep garment also acts to swaddle the infant and prevents the infant from waking itself by reflexive movement of its arms.

The sleep garment is equipped with a Velcro™ type hook and eye loop fastener on the backside of the garment to lock into the Velcro™ connector on the crib sheet. The Velcro™ on the crib sheet and sleep garment are positioned to ensure the infant cannot break free from the Velcro™ by moving its body around.

BRIEF DESCRIPTION OF THE DRAWINGS

Further features and advantages will be apparent from the following Detailed Description of the Invention, given by way of example, of a preferred embodiment taken in conjunction with the accompanying drawings, wherein.

DETAILED DESCRIPTION OF THE INVENTION

Figure 1:
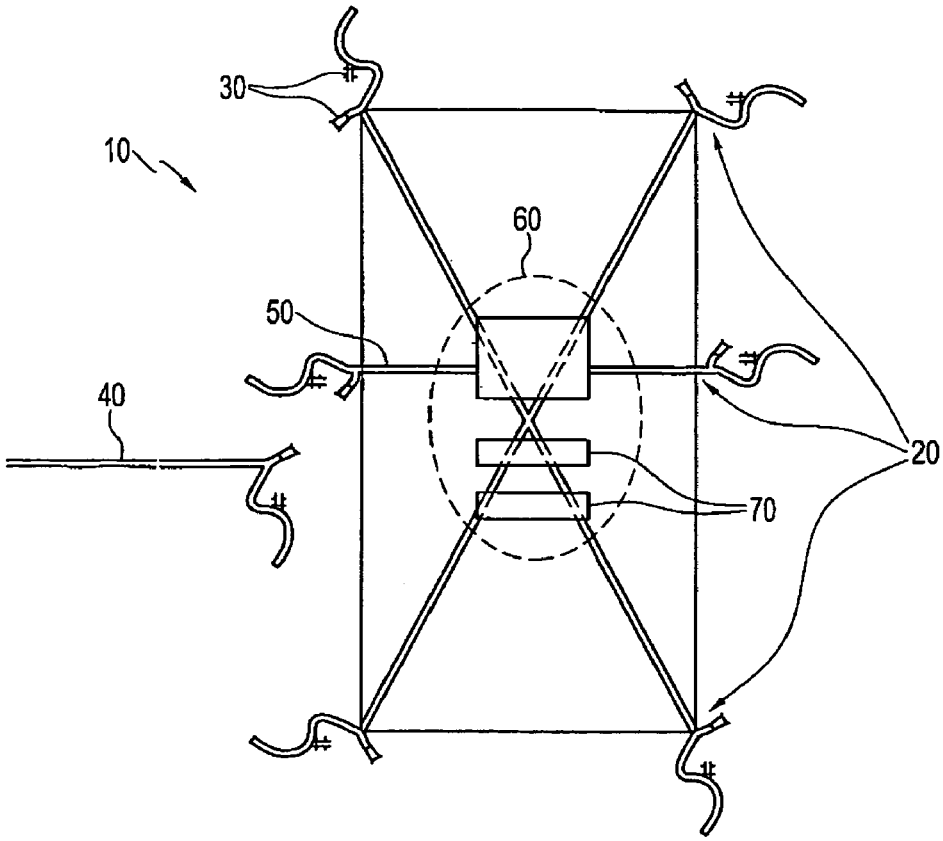
FIG. 1 is a plan view of the crib sheet.

FIG. 1 shows the crib sheet 10 of the present invention. The crib sheet 10 has strips 20 of reinforcing material sewn between two layers of fabric. The strips 20 of reinforcing material form six attachment points 30 for attachment to the crib bars (not shown). The attachment points 30 extend beyond the outer edge of the crib sheet 10, are adjustable in length, and have a locking clip mechanism in order to connect to crib bars or bed frames of different sizes and configurations. In an alternative embodiment, a locking clip can be used to connect a separate strap 40 which may then be clipped, for example, to a bed frame instead of a crib. The attachment points 30 can be used to attach various travel straps for affixing the crib sheet to articles other than a crib. The crib sheet can have any number of desired locking clips or strips of reinforcing material greater than 6. In the preferred embodiment, the crib sheet has a strip 20 of reinforcing material extending from each of the 4 corners of the crib sheet and, as is discussed further below, a horizontally oriented strip of reinforcing material 50 is preferably positioned at the level of the torso or shoulders of the infant (i.e. the infant's point of greatest strength and leverage).

A connector 60, preferably made of hook and loop material, (Velcro™) is approximately centrally positioned on the crib sheet 10, at the center of the crossing point of the strips 20 reinforcing material, thereby placing the infant's back at the most secure position. A lower portion 70 of the connector 60 preferably keeps the lower portion of the sleep garment (see FIGS. 2(*a–c*)) secured to the crib sheet 10. The infant still has room to kick and move its hips within the sleep garment, but is prevented from pulling the entire bottom portion of the sleep garment up, putting pressure on the connector 60 at the shoulders.

Although in the preferred embodiment the crib sheet incorporates strips 20 of reinforcing material, alternate embodiments will be readily apparent to persons skilled in the art that do not include such strips. For example, the need for such strips would be eliminated if the crib sheet 10 itself is made of sturdier material. In such an embodiment the attachment points 30 would simply form part of the edge of the crib sheet or would be connected thereto.

The connector 60 may have any one of a number of possible configurations, provided the back of the infant is centrally situated between the attachment points 30, (i.e. in the preferred embodiment at the crossing point of the strips 20 of reinforcing material) and the lower portion of the sleep garment is securely affixed to the crib sheet 20.

In an alternate embodiment, the crib sheet has only two attachment points located opposite one another on either side of the connector 60. Although six attachment points ensures that the crib sheet will not be shifted or moved by the movements of the infant, two attachment points, provided they are positioned such that they are aligned with the torso (preferably the shoulders) of the infant, can be sufficient. It is essential that the placement of the crib sheet be fixed in a way that resists the infant's movements at its point of greatest leverage (i.e. the torso or shoulders).

In a further alternate embodiment, the crib sheet may be a fitted sheet or a sheet similar to a pillow-case, having an inner cavity to receive a mattress, pillow or cushion.

Figure 2A:
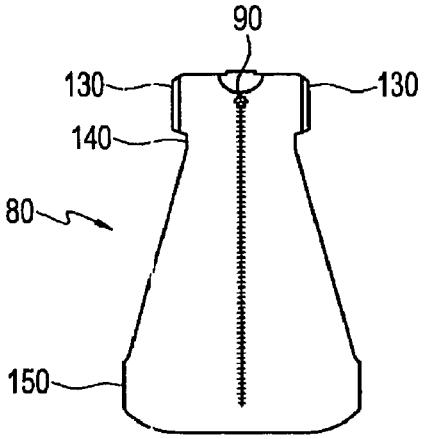
FIGS. 2(*a–c*) show three different views of the sleepwear garment.
Figure 2B:
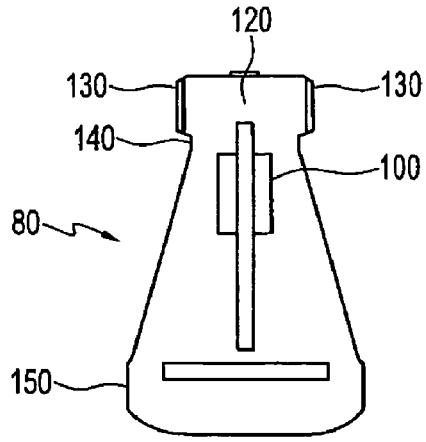
Figure 2C:
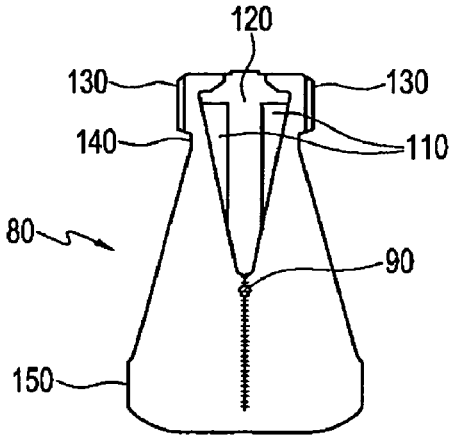
Figure 3C:
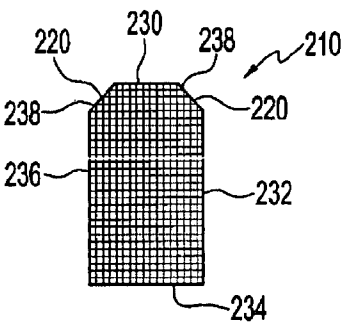
FIGS. 3(*a–d*) show the sleepwear garment and its components.
Figure 3D:
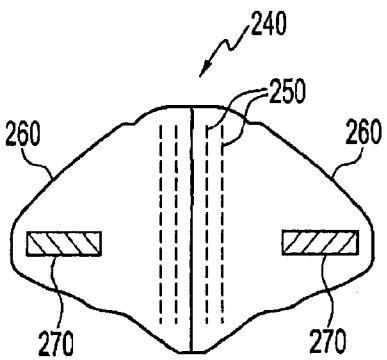
Figure 3B:
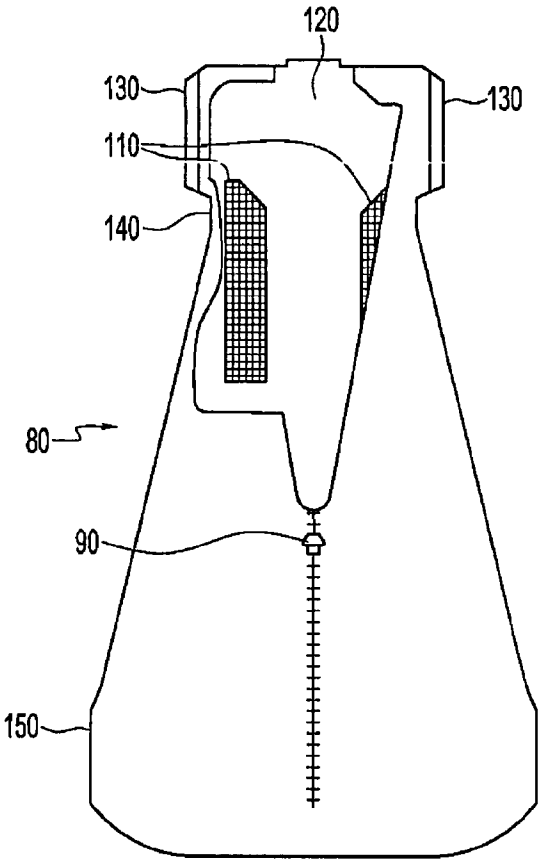
Figure 3A:
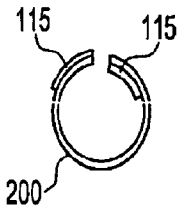

Referring to FIGS. 2*a–c*, three views of the sleep garment 80 of the present invention are shown: (a) front, closed; (b) back; and (c) front, open. The sleep garment 80 zips up in the front with a locking zipper 90 that may open at the top or bottom.

FIG. 2(*b*) shows the placement of hook and loop strips 100 on the back of the sleep garment 80. The strips 100 are placed such that when they are engaged with the connector 60 of the crib sheet (see FIG. 1) the infant's back is secure. The Velcro™ strips 100 may be placed in several different configurations, so long as the infant's back and the lower portion of the sleep garment 80 are secure.

Referring to FIGS. 1 and 2(*b*), in the preferred embodiment of the present invention, the Velcro™ strips 100 are placed on the sleep garment 80 in several vertical strips from the upper shoulders down to the lower leg area. There is also a horizontal strip of Velcro™ at the level of the infant's lower legs running almost the entire width of the back of the sleep garment 80. The connector 60 of the crib sheet 10 has three portions: a square of Velcro™ to secure the torso portion of the sleep garment 80, and two horizontal strips 70 to secure the lower body and leg portions of the sleep garment 80. The positioning of the connector 60 and the Velcro™ strips 100 are intended to achieve the following:

a) attach the infant's torso or shoulders (i.e. the infant's point of greatest strength and leverage) to the crib sheet;

b) attach the infant's torso or shoulders to the crossing point of the crossing point of the strips 20 of the crib sheet; and c) attach the lower portion of the sleep garment to the crib sheet in a manner that allows some movement of the infant's legs.

FIGS. 2(*c*) and 3(*b*) show the sleep garment 80 with the zipper 90 open so that the sleeves 110 on the inside of the sleep garment 80 can be seen. The sleeves 110 are preferably sewn directly into the side seam of the sleep garment 80. The sleeves 110 may alternatively be sewn to the back portion 120 of the sleep garment 80, or to both the side seam and the back portion 120. The infant is placed in the sleep garment 80 with its back against the back 120 of the garment and with its arms placed in the sleeves 110 instead of through the arm holes 130. Once the sleep garment 80 is zipped up, the infant is effectively swaddled.

The sleep garment 80 of the present invention is designed to be comfortably worn, having a form fitting torso area 140, and a wide lower portion 150. Preferably, the garment 80 has no straps on it. The sleep garment 80 may have a quilted back to add extra comfort for the infant while sleeping on the crib sheet 10. With this design, there. is no chance that the baby's skin or body will come in direct contact with the Velcro™ of the connector 60 on the crib sheet 10.

The sleep garment 80 of the present invention is designed to be comfortably worn, having a form fitting torso area 140, and a wide lower portion 150. Preferably, the garment 80 has no straps on it. The sleep garment 80 may have a quilted back to add extra comfort for the infant while sleeping on the crib sheet 10. With this design, there is no chance that the baby's skin or body will come in direct contact with the Velcro of the connector 60 on the crib sheet 10.

Referring to FIGS. 2(*c*) and 3(*a*)–(*d*), several different embodiments of the inner sleeves 110 are shown.

Referring to FIGS. 2(*c*), 3(*a*) and 3(*b*), two sections of fabric, formed into tubes 200 are sewn along the inside and back portion of the sleep garment 80 to make inner sleeves 110.

FIG. 3(*a*) shows an alternate embodiment wherein each inner sleeve 110 is a tube 200 of fabric that closes along its length with longitudinally oriented hook and loop strips 115. With the strips 115 the width of the inner sleeves 110 can be adjusted.

FIG. 3(*b*) shows that the upper portion of the inner sleeves 110 are angled to accommodate the infant's shoulders. FIG. 3(*b*) also shows the sleeves 110 sewn onto the back portion of the sleep garment 80, however, it is preferred that they be sewn into the side seam of the sleep garment 80 for ergonomic and durability reasons.

The sleeves 110 may also be fully enclosed, with or without a wrist cuff. The inner sleeves 110 may also be sewn to the sleep garment 80 so that they are connected to the sleep garment 80 only at their upper ends, such that the sleeves 110 may be reversed and pulled out of the armholes 130 of the sleep garment 80 to form outer sleeves (not shown) that may be used for warmth, once the infant is older and no longer at risk for SIDS, etc.

Referring to FIG. 3(*c*), in an alternate embodiment, a single panel of fabric 210 with angled upper quadrants 220 may be sewn onto the inside back portion of the sleep garment 80 leaving the upper portion of the panel 210 open for the infant's arms to be placed securely. The panel 210 is sewn along its edges 230, 232, 234 and 236. The edges 238 are left unsewn so as to form openings for the infants arms. "Sleeves" are formed naturally by the weight of the infant's torso on the panel 210 once the arms are placed underneath or behind the panel. Alternatively, stitching may be placed vertically, parallel to the infant's torso and adjacent arm and leaving enough room for the arms to be positioned comfortably, to form sleeves. The angle of the edges 238 is necessary to inhibit the bunching of fabric under the infant's armpits.

Referring to FIG. 3(*d*), a further alternate embodiment, having a "manta ray" shaped panel of fabric 240 is shown. The panel 240, which can be considered to be a "blanket within a blanket", may be sewn into the inner, back portion of the sleep garment 80 using centrally disposed lines of stitching 250. Each side of the panel 240 ends in a tapered section 260 and has a hook and loop fastener 270. When in use, the infant is placed in the sleep garment 80 such that its back lies on top of the stitching 250, each section 260 of the panel is folded around the outside of a respective one of the infant's arms, then the hook and loop fasteners 270 of the arms are connected to one another behind the infant's back. In this manner inner sleeves are formed that are adjustable in size.

Referring to FIGS. 2(*c*) and 3(*a*–*d*), the inner sleeves 110, the panel fabric 210, and the "manta ray" 240 are three alternate embodiments of arm restraint mechanisms that effectively and comfortably restrain the infant's arms within the sleep garment 80. The arm restraint mechanisms are not intended to immobilize the infant's arms, which would cause discomfort. Rather, the arm restraint mechanisms ideally allow some movement but prevent the infant from bringing its arms up to its chest. This degree of restraint allows the infant to remain comfortable while preventing use of the arms to roll over or to move about within the sleep garment or the crib. In addition, it prevents reflexive or startled movements of the infant's arms from, for example, striking the infant's face.

In contrast to prior art devices, (see, for example, the '048 patent) in the preferred embodiments of the present invention, there are no straps. Such straps present a choking hazard if loosened or unfastened.

In an alternate embodiment of the invention the ends of the inner sleeves may be sealed so that there is no hole from which the infant's hands can emerge.

What is claimed is:

1. An infant sleeping system, comprising:

a crib sheet having at least six attachment points and a hook and loop connector, wherein one of said attachment points is located at each of four corners of said crib sheet, wherein two of said attachment points are located opposite one another on each of two longitudinal edges of said crib sheet, and wherein said hook and loop connector is located between said two attachment points located on said longitudinal edges; and a sleep garment to be worn by an infant, said garment having:

an arm restraint mechanism operative to restrain movement of the infant's arms;

a torso portion;

a lower portion operative to cover the infant's legs and to allow movement of the legs within said garment;

hook and loop connector strips on a back of said garment, said hook and loop connector strips operative to engage said hook and loop connector of said crib sheet when the infant is placed on its back on said crib sheet;

wherein said attachment points are operative to connect said crib sheet to a bed frame or a crib frame; and wherein engagement of said hook and loop connector strips and said hook and loop connector is operative to prevent the infant for rolling over onto its front.

2. A system according to claim 1, wherein said crib sheet further comprises strips of reinforcing, material extending between opposite ones of said attachment points.

3. A system according to claim 1, wherein leg portion of said garment is wider than said torso portion.

4. A system according to claim 1, wherein said arm restraint mechanism is one of a set of inner sleeves sewn onto an inside of said garment, a panel of fabric sewn onto the back of the inside of said garment, and a manta ray shaped panel of fabric having tapered arms.

5. A system according to claim 1, wherein said garment is opened and closed by means of a locking zipper.

6. A system according to claim 1, wherein said garment has no straps.

7. A system according to claim 1, wherein said hook and loop connector, said hook and loop connector strips and said two attachment points located on said longitudinal edges are positioned relative to one another such that when the infant is place on said crib sheet such that said hook and loop connector and said hook and loop connector strips are engaged, the infant's shoulders lie between said two attachment points located on said longitudinal edges.

8. A system according to claim 1, wherein said hook and loop connector strips on said back of said garment are located on a back of said torso and lower portion of said garment.

9. An infant sleeping system, comprising:

a crib sheet having at least 2 attachment points and a hook and loop connector, wherein said attachment points are located opposite one another on either side of said hook and loon connector; and a sleep garment to be worn by an infant, said garment having:

an arm restraint mechanism operative to restrain movement of the infant's arms;

a torso portion;

a lower portion operative to cover the infant's legs and to allow movement of the legs within said garment;

hook and loop connector strips on a back of said garment, said hook and loop, connector strips operative to engage said hook and loop connector of said crib sheet when the infant is placed on its back on said crib sheet;

wherein said attachment points are operative to connect said crib sheet to a bed frame or a crib frame;

wherein said attachment points, said hook and loop connector and said hook and loop connector strips are positioned such that when said hook and loop connector strips and said hook and loop connector are engaged the infant's torso lies directly between said attachment points; and wherein engagement of said hook and loop connector strips and said hook and loop connector is operative to prevent the infant for rolling over onto its front.

10. A system according to claim 9, wherein said crib sheet further comprises a strip of reinforcing material extending between said attachment points.

11. A system according to claim 9, wherein leg portion of said garment is wider than said torso portion.

12. A system according to claim 9, wherein said arm restraint mechanism is one of a set of inner sleeves sewn onto an inside of said garment, a panel of fabric sewn onto the back of the inside of said garment, and a manta ray shaped panel of fabric having tapered arms.

13. A system according to claim 9, wherein said garment is opened and closed by means of a locking zipper.

14. A system according to claim 9, wherein said garment has no straps.

15. A system according to claim 9, wherein when said hook and loop connector and said hook and loop connector strips are engaged, the infant's shoulders lie between said two attachment points.

16. A system according to claim 9, wherein said hook and loop connector strips on said back of said garment are located on a back of said torso and lower portion of said garment.

17. A system according to claim 9, wherein said crib sheet comprises a further four attachment points located at each of the four corners of said crib sheet.

* * * * *